US006305876B1

(12) United States Patent
Yoshino et al.

(10) Patent No.: US 6,305,876 B1
(45) Date of Patent: Oct. 23, 2001

(54) MATERIAL AND CONSTRUCTION METHOD OF PREVENTION OF SCOUR FOR THE UNDERWATER STRUCTURE

(75) Inventors: Masato Yoshino; Yoshikazu Ishikawa; Kazuo Oyama; Sukeo Tamura; Takahito Okubo; Saiji Nozaki; Toshihiro Tanaka, all of Osaka (JP)

(73) Assignee: Kyowa Kabushiki Kaisha (JP)

( * ) Notice: Subject to any disclaimer, the term of this patent is extended or adjusted under 35 U.S.C. 154(b) by 0 days.

(21) Appl. No.: 09/182,501

(22) Filed: Oct. 30, 1998

(30) Foreign Application Priority Data

Oct. 31, 1997 (JP) ..... 9-336254

(51) Int. Cl.[7] ..... E02B 3/04

(52) U.S. Cl. ..... 405/17; 405/15; 405/52; 405/73; 428/36.1

(58) Field of Search ..... 405/15, 16, 17, 405/18, 19, 21, 32, 52, 73, 74; 428/36.1; 210/164, 165; 383/12, 16, 102

(56) References Cited

U.S. PATENT DOCUMENTS

| | | | | |
|---|---|---|---|---|
| Re. 36,057 | * | 1/1999 | Martin, Sr. | 210/241 |
| 618,943 | * | 2/1899 | Kahweiler | 383/102 X |
| 752,637 | * | 2/1904 | Mankedich | 405/16 |
| 781,494 | * | 1/1905 | Coltharp | 405/16 |
| 1,480,192 | * | 1/1924 | Worsfold | 37/307 |
| 3,315,408 | * | 4/1967 | Fisher | 406/16 X |
| 3,316,670 | * | 5/1967 | Johnson | 43/9.1 |
| 3,561,219 | * | 2/1971 | Nishizawa et al. | 405/19 |
| 4,052,800 | * | 10/1977 | Fuhrboter et al. | 37/314 |
| 4,142,754 | * | 3/1979 | Colvin | 294/77 |
| 4,154,061 | * | 5/1979 | Umemoto et al. | 405/19 |
| 4,196,534 | * | 4/1980 | Shibamoto | 40/10 R |
| 4,220,421 | * | 9/1980 | Thorne | 405/211 |
| 4,266,429 | * | 5/1981 | Brovold | 73/864.63 |
| 4,388,739 | * | 6/1983 | Martinon et al. | 8/150 |
| 4,420,275 | * | 12/1983 | Ruser | 405/18 X |
| 4,594,206 | * | 6/1986 | Grafton | 405/32 X |
| 4,629,651 | * | 12/1986 | Davis | 383/16 X |
| 4,922,847 | * | 5/1990 | Ryder, Jr. et al. | 363/16 X |
| 5,050,999 | * | 9/1991 | Van Loon, III | 383/76 |
| 5,051,028 | * | 9/1991 | Houck et al. | 405/45 |
| 5,104,714 | * | 4/1992 | Leiber et al. | 428/131 |
| 5,118,201 | * | 6/1992 | Cook | 383/12 |
| 5,158,395 | * | 10/1992 | Holmberg | 405/21 |
| 5,257,878 | * | 11/1993 | Peterson | 405/15 |
| 5,287,985 | * | 2/1994 | Hatayama | 220/401 |
| 5,472,297 | * | 12/1995 | Heselden | 405/32 X |
| 5,511,904 | * | 4/1996 | Van Egmond | 405/52 |
| 5,951,201 | * | 9/1999 | Brown | 405/19 |
| 5,965,467 | * | 10/1999 | Stevenson et al. | 442/218 |

* cited by examiner

*Primary Examiner*—David Bagnell
*Assistant Examiner*—Jong-Suk Lee
(74) *Attorney, Agent, or Firm*—Rader, Fishman & Grauer

(57) ABSTRACT

A net includes a bag body, an endless suspension rope, and a top closing rope. The bag body prevents scour of an underwater structure, and is formed into a mesh by a knitted fabric. The endless suspension rope is inserted through the mesh adjacent to an opening portion of the bag body. The top closing rope closes the opening of the bag body, and is inserted through a mesh adjacent to the mesh through which the suspension rope is inserted.

19 Claims, 5 Drawing Sheets

MATERIAL AND CONSTRUCTION METHOD OF PREVENTION OF SCOUR FOR THE UNDERWATER STRUCTURE

BACKGROUND OF THE INVENTION

Field of the Invention

The present invention relates to a scour prevention material for an underwater structure. More particularly, the present invention relates to a scour prevention material for preventing a structure, such as a bridge or a revetment, provided in a river or a sea shore, in particular, a riverbed or the bottom of the sea under the water surface, near a bridge pier in the river or the sea, from being scoured by flow of water, wave, or the like, when the underwater structure is installed under a rapid tidal stream.

It is well known that when the underwater structure is placed in the bottom of the sea, the structure becomes a resistance against the tidal stream, thus causing swirls, and the ground of the bottom of the sea around the structure is scooped out, with the result that a so-called scour phenomenon occurs which may cause the structure to fall down.

Further, the scour phenomenon is observed for bridge piers of bridges mounted in the river or the sea, and the same phenomenon is also observed with respect to corrosion of the ground of the underwater structure, such as a bank of a sea shore or river.

Even if the location to be scoured is piled up with gravel in advance, or the part that has been scoured is filled with gravel, the gravel is washed away by the water stream, and removed without providing any effect.

Conventionally, various methods for preventing scour have been employed, for example, gabions filed with small stones and crushed stones are placed on the bottom portion near the underwater structure, or a large amount of concrete is deposited, or the structure is embedded in the ground to a greater depth. For the revetment, too, such methods as depositing concrete or using wave suppressing blocks, such as Tetrapods, have been employed.

With the conventional scour prevention method mentioned above, the scour cannot be prevented to a satisfactory level. In the case where a widely used iron gabion is employed, in particular, the gabion tends to get out of shape in a short period of time due to corrosion in the sea or river, and the stones may come out of the gabion. Further, since the gabion is made of iron, it is impossible to flexibly change the shape so that the gabion is closely attached to the structure to be protected, with the result that a large gap or clearance arises between the gabion and the structure. As a result, the portion between the gabion and the structure has an increased coefficient of water conveyance, and thus suffers from a scour phenomenon.

Further, the conventional scour prevention method requires underwater work at the bottom of the sea or river, which is hard to be done under rapid water stream, and it is necessary to reinforce a wide range or area of the ground around the structure. For the Tetrapods or gabions to be sunk to a sufficient depth in the ground during the underwater work, sand and gravel are scattered and placed over the bottom surface of the sea, or the like. Where ready-made articles, such as Tetrapods, are placed under rapid water stream, however, delicate works or operations suitable for the construction field cannot be performed, resulting in undesirable increases in the time, labor and the cost.

SUMMARY OF THE INVENTION

The present invention is concerned with a scour prevention material for an underwater structure, comprising: a bag body formed by a knitted fabric, the bag body satisfying a relationship as represented by an expression: $3 \leqq N/M \leqq 20$, where M is a diameter of a net yarn, and N is a long side of a mesh; an endless suspension rope that is inserted through the mesh near an opening portion of the bag body; and a top closing rope for closing the opening of the bag body, the top closing rope being inserted through a mesh near the mesh through which the suspension rope is inserted.

PREFERRED EMBODIMENTS OF THE INVENTION

Figure 1:
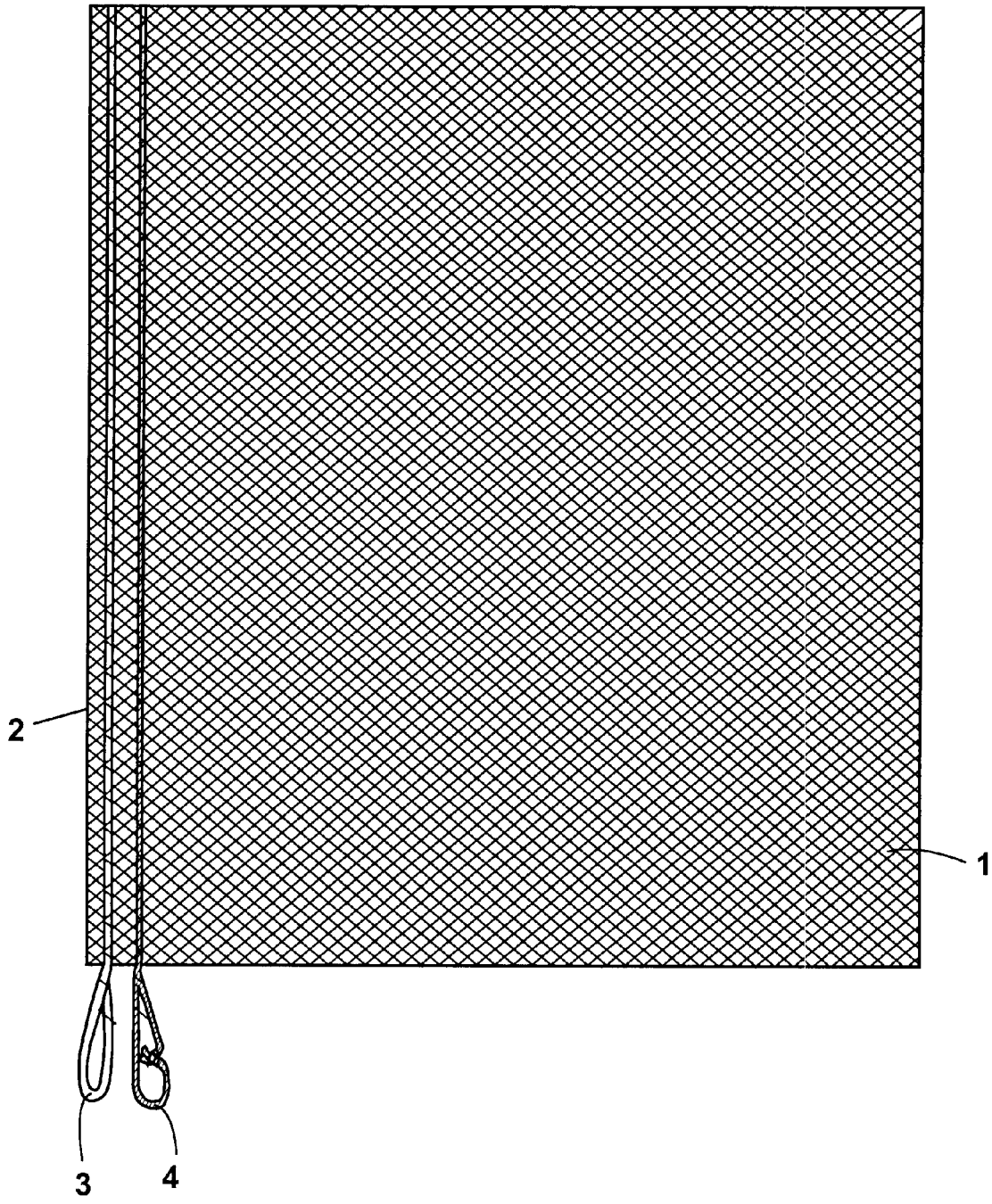
FIG. 1 is a schematic view of a bag body used in the present invention.

When the sour prevention material of the present invention is sunk and placed in the bottom surface of water in which an underwater structure has been already scoured or is going to be scoured under the water surface, the water passes through the bag body having a porosity of 45 to 90%, and therefore the pressure of flowing water is not applied to the bag, thus keeping the scour prevention material from being carried or swept away by the water. Further, the stored solid materials are held or supported by the bag without being carried away, and thus serve to prevent occurrence of scour. While the porosity is determined depending upon the size of the solid masses contained in the bag, the pressure of flowing water is applied to the bag if the porosity is smaller than 45%, thereby causing scour at around the bag body. If the porosity is larger than 90%, the capability of holding the solid masses deteriorates.

Since the bag body is formed by a knitted fabric having a suitable ductility, and the knitted fabric has a smaller form maintaining ability than a woven fabric, the bag formed by the knitted fabric has a great shape applicability, and suitably deforms in accordance with the shape of the place of installation, when it is placed in position with the solid masses stored therein. Further, the ductility is in the range of 30 to 80%, and therefore the shape appropriately changes according to the configuration of the ground and the shape of the underwater structure, so that the scour prevention material is closely attached to the bottom of the water and the structure. The shape applicability of the bag body deteriorates if the ductility is 30% or less, and an operation to hang up the bag and place it in position becomes hard to perform if the ductility is 80% or larger.

Furthermore, charged bag bodies each having the minimum size determined depending upon the rate of water flow may be separately thrown into the water, thus assuring excellent operability or work efficiency. Also, since installation may be done depending upon circumstances, a required number of bags each having a size large enough to resist the pressure of flowing water may be attached to the periphery of the structure at the construction field, and sunk onto the bottom of water when the structure is sunk into the flowing water. In this method, when the structure reaches the bottom of the water, the scour prevention materials having a soft structure are uniformly arranged around the underwater structure while being closely attached thereto, thus accomplishing the operation to prevent scour at the same time as installation of the structure. In the case where the structure is a scaffold, or the like, that is only temporarily installed, the scour prevention materials may be kept being attached to the structure, so that they can be removed at the same time that the structure is removed.

While the bag body is preferably formed by a mesh knitted in the form of a raschel net, it may be knitted into the form of an English knot net or a knotless net.

With regard to the bag body used in the present invention, there is a special relationship between the thickness of the net yarn and the size of the mesh.

More specifically, the diameter M of the net yarn and the long side N of the mesh need to be controlled so as to satisfy the relationship as represented by $3 \leqq N/M \leqq 20$, where both M and N are in the unit of mm. If the mesh is defined by the sides having the same length, the length N is that of these sides. If the sides of the mesh have different lengths, the length N is that of the longer side. In the case of a circular shape, the length N represents its radius, and, in the case of an ellipse, the length N represents the longer radius.

If M is larger than N/3, that is, $M>N/3$, the strength of the net is increased, but the rigidity is also increased, resulting in a reduced freedom in the deformation of the bag body. Further, the porosity of the net is reduced, and the resistance to the water stream is increased, thus causing a risk that scour takes place at around the location where the scour prevention material is placed.

If M is smaller than N/20, that is, $M<N/20$, on the other hand, the strength of the net is reduced, the risk of breaking the net during work is increased, and the size of the mesh significantly changes since the net stretches to a great extent, thus causing a risk that the solid masses come out of the bag.

Accordingly, the diameter of M of the net yarn and the long side N of the mesh need to be controlled so as to satisfy the relationship of $3 \leqq N/M \leqq 20$.

If the diameter M of the net yarn and the long side N of the mesh satisfy the relationship of $3 \leqq N/M \leqq 20$, and the bag body of the invention is formed by a knitted fabric that has a porosity of 45% to 90% and a ductility of 30% to 80%, and satisfies a relationship as represented by $L \leqq \pi(4 \times 1.8) \cdot D$ where L is a length of one side, and D is a long diameter of a solid mass, the charged solid masses or materials do not flow out of the mesh in any rapid stream, no matter how the place of installation is shaped. In the above expression, 1.8 represents a safety coefficient. When the net that satisfies these expressions is used, the solid bodies do not come out of the bag even if the water stream is rapid, or the net is sunk to a large depth, or the bottom portion has variously changing shapes. Further, if the solid masses contained in the scour prevention material include large-diameter masses located in its surface layer portion that contacts with the water stream, and small-diameter masses located in its inner layer portion, a large water flow energy is successively dispersed, thus making it possible to reduce the water flow energy so that to a level that cannot cause scour.

The lower limit of the size of the bag body may be determined so that the bag contains solid masses whose weight is large enough to resist the pressure of flowing water, and the upper limit may be suitably determined so that the strength of the bag is large enough to hold the charge solid masses, and also in view of the operability or work efficiency. The bag may be made of a material selected from synthetic fibers, such as polyester, polyamide, aromatic polyamide, polyethylene, polypropylene, polyvinyl chloride, polyvinylidene chloride, and polyvinylidene fluoride, and/or natural fibers, such as cotton and flax.

While the yarn used for knitting the net is selected depending upon the size of the bag body, that is, the inner volume and the weight of the charged solid masses, a twisted yarn made of nylon or polyester having a diameter of 1 mm to 12 mm is preferably used for the net, and a twisted yarn having a greater diameter of 5 mm to 25 mm is used for the suspension rope.

The bag body is provided with the suspension rope that passes through the mesh of the bag. The bag body of the scour prevention material needs to be charged with solid masses of 0.1 to 20 tons, and it is therefore extremely dangerous if the load is applied to a part of the scour prevention material to cause it to be inclined when the bag is hung up or suspended.

In the conventional bag body, therefore, two to four reinforcing ropes are provided on the side face, to surround the side face and bottom of the bag, and the bag body is hung up with these ropes. However, since the force is applied to the reinforcing ropes serving as suspension ropes, and concentrated at two to four locations where the ropes engage with the bag, the other portions of the bag body to which no force is applied are deformed, thus causing a problem that the load is biased and a stable suspending operation cannot be performed. It is thus necessary to distribute the suspension force to the whole bag body so as to ensure the safety of the operation.

If the net yarn constituting the bag body is directly used as a suspension rope, however, the load of the charged masses is concentrically applied to the net yarn, resulting in cutting of the net yarn.

According to the present invention, therefore, the net yarn is not directly hung up, but the suspension rope is inserted through the mesh near the opening portion of the bag body, and this rope is made endless. Then, a certain number of rope portions are pulled out from the mesh at almost equal intervals, to thus form suspension loops, and a suspension tool for hanging up is coupled to the loops.

The suspension rope passes through a mesh at the opening end of the opening portion of the bag body or a mesh located below the same mesh. It is preferable that the suspension rope passes through a mesh located two or three steps lower than the mesh of the opening end, since the risk of breaking the net yarn is eliminated.

Although the top closing rope for closing the opening of the bag body preferably passes though the mesh located below the mesh through which the suspension rope passes, the top closing rope may pass through the same mesh as that of the suspension rope. Since the opening of the bag body is closed when it is hung up with the loops of the suspension rope, it is easy to close the opening by tightly winding the top closing rope around the opening portion of the bag.

Next, a method of preventing scour of an underwater structure will be described below.

The bag body is received by a frame body, and the end portion of the opening portion of the bag body is suspended outside the opening of the frame body, so that the opening portion of the bag body is opened.

It suffices that the frame body has a peripheral wall, namely, the frame body does not necessarily include a bottom portion. The frame body may have a cylindrical shape or a prism-like shape.

The solid masses are then put into the bag body through its opening portion, such that the amount of the solid masses is not so large as filling up the bag body, but small enough to leave a space above the masses when the bag body is hung up.

After charging the bag with the solid masses, the endless suspension rope that passes through the mesh near the opening portion of the bag body is pulled out from a certain number of mesh holes, at almost equal intervals, so as to form suspension loops. Then, a suspension tool, such as a hook of a crane, is coupled to the suspension loops, so as to temporarily hang up the bag body. In this step, the bag body is hung up in the air, away from the frame body, with the opening of the bag body being incompletely closed.

In the next step, the opening portion of the bag body is tightly wound and thus closed by the top closing rope that passes through the mesh near the mesh through which the suspension rope passes. In this manner, the opening of the bag body that is temporarily hung up is closed with the top closing rope. While it is preferable to insert the top closing rope through the mesh located below the mesh through which the suspension rope passes, for the sake of easiness in closing the opening, the top closing rope may pass through the same mesh through which the suspension rope passes.

It is preferable that the top closing rope be inserted in advance through the mesh of the bag body, for improved efficiency and reliability with which the opening of the bag is closed. It is, however, possible to use a rope that does not pass through the mesh nor connected with the bag body. For example, an independent rope may be used to tie up a portion of the bag blow the mesh through which the suspension rope passes. The work efficiency is improved if the suspension rope is wound by the remaining portion of the tope closing rope.

The scour prevention material formed in the above manner assumes a conical shape as seen from the side face when it is hung up. When the bag body charged with the solid masses is hung up, a conical space corresponding to 25 to 80% of the height of the bag needs to be present at the upper part of the scour prevention material as seen from the side face thereof. If the space is less than 25% of the height, the bag body is shaped such that its height exceeds 30% of its diameter, due to the weight of the solid masses, and the body looks under tension, and does not fit the unstable configuration of the water bottom with protrusions and recesses, rocks, or the like. The stability of the bag body also deteriorates. If the space exceeds 80% of the height, the diameter of the scour prevention material becomes too large, and the net fabric becomes redundant and loose. Also, the bag body may be swept away from the water stream due to the light weight.

The suspension rope is formed of polyester, polyamide, polypropylene, polyethylene, or the like, and has a diameter of 5 mm to 25 mm though it varies depending upon the load, and has a larger thickness than that of the yarn forming the bag body. These features are desirable since the suspension rope provides an increased contact area with the net yarn, and is prevented from being cut off.

The top closing rope is preferably formed of polyester, polyamide, polypropylene, polyethylene, or the like, and has a diameter of 3 mm to 12 mm.

One embodiment of the present invention will be specifically described.

FIG. 1 shows a bag body used in the present invention, and reference numeral 1 denotes the bag body formed in a bag-like shape from two sheets of knitted fabrics (not shown) on the front side and back side. The bag body 1 may be provided with a bottom portion. Three sides of the bag body are closed. Reference numeral 2 denotes an opening portion of the bag body, and a suspension rope 3 and a top closing rope 4 are inserted through a mesh near the opening portion.

In FIG. 1, the suspension rope 3 passes through the third row of the mesh as counted from the opening of the bag body, and the top closing rope 4 passes through the third row of the mesh as counted from the row through which the suspension rope passes. Thus, it is preferably that these ropes pass through the second or third row of the mesh.

Figure 2:
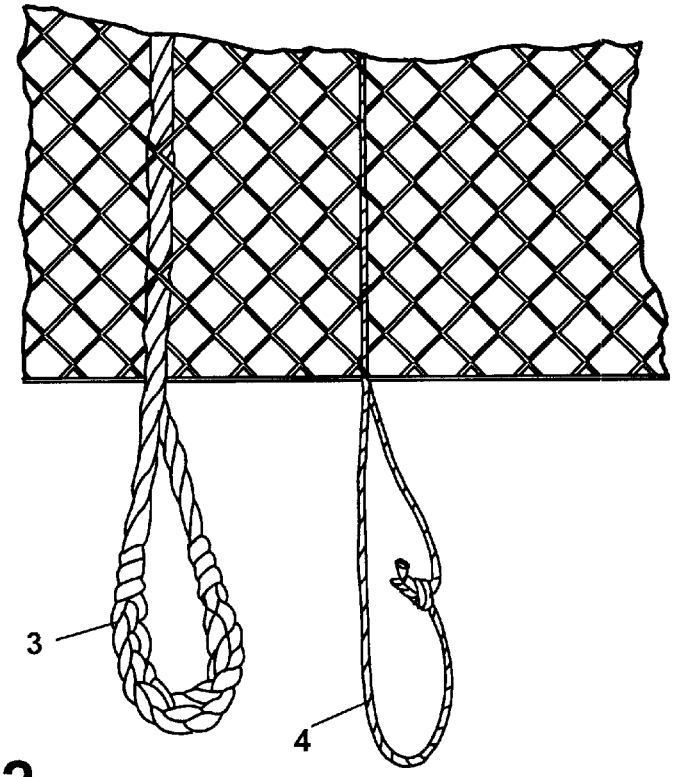
FIG. 2 is a schematic view of a suspension rope and a top closing rope that are located in the vicinity of an opening portion of the bag body used in the present invention.

FIG. 2 shows the suspension rope 3 and the top closing rope 4 in enlargement, when these ropes are inserted through the mesh to be located in the vicinity of the opening portion of the bag body. It is preferable, in view of the work efficiency, that each of the ropes be formed in an endless shape with its opposite ends being connected to each other, so that the rope is not pulled out of the mesh. The suspension rope has a large diameter.

Figure 3:
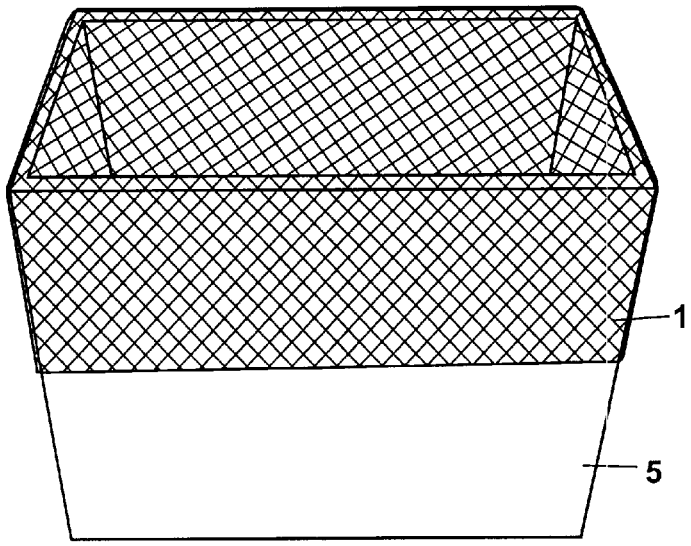
FIG. 3 is a schematic view showing the bag body that is put into a frame body with its opening being kept opened.

FIG. 3 shows a state in which the bag body is placed on a frame so as to be charged with solid masses. Reference numeral 5 denotes a frame body. While the frame body 5 is formed in a prism-like shape having a rectangular opening in this embodiment, it may be formed in a cylindrical shape. The bag body 1 is inserted into the frame body and opening, and its opening end is hung down onto the outer wall of the frame. The use of the frame body ensures the opening and inner space of the bag body, which makes it easy to charge the bag body with solid masses.

Figure 4:
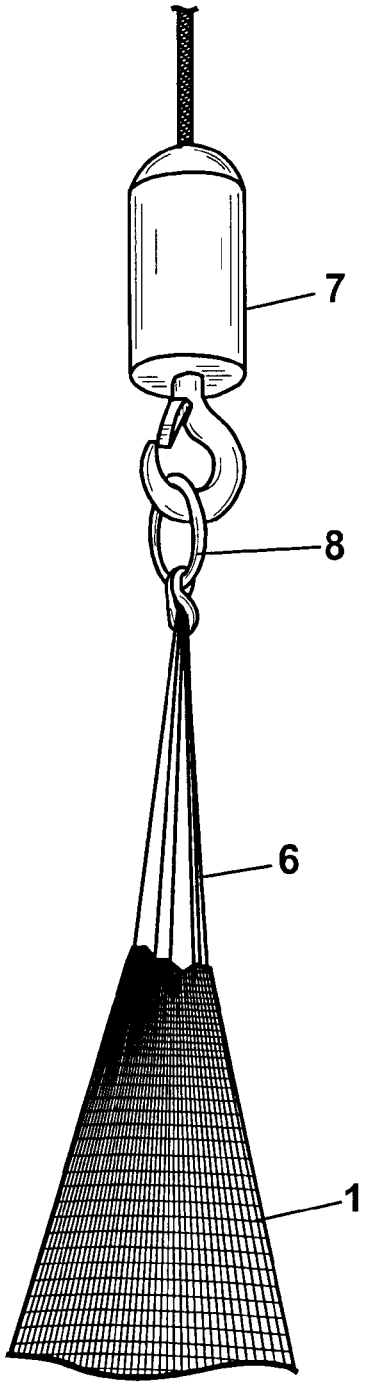
FIG. 4 is a schematic view showing the bag body that is charged with solid masses and temporarily suspended.

FIG. 4 shows an opening portion of the bag body of the present invention that is temporarily suspended for closing the opening after charging the bag with solid bodies. Reference numeral 1 denotes the bag body, and reference numeral 6 denotes a suspension rope formed by pulling out the suspension rope from the mesh through which the rope passes, at almost equal intervals. A suspension tool 7 is coupled to the suspension rope so as to hang up the bag body. The suspension rope may be directly hung on a hook of a crane, or the like. In this embodiment, however, loops of the suspension rope are bundled together and passed through a suspension ring 8, as shown in this figure, and the ring is then passed through the loops so that the suspension loops and suspension ring are connected to each other, and the suspension ring is hung on the suspension tool. This method assures improved work efficiency.

Figure 5:
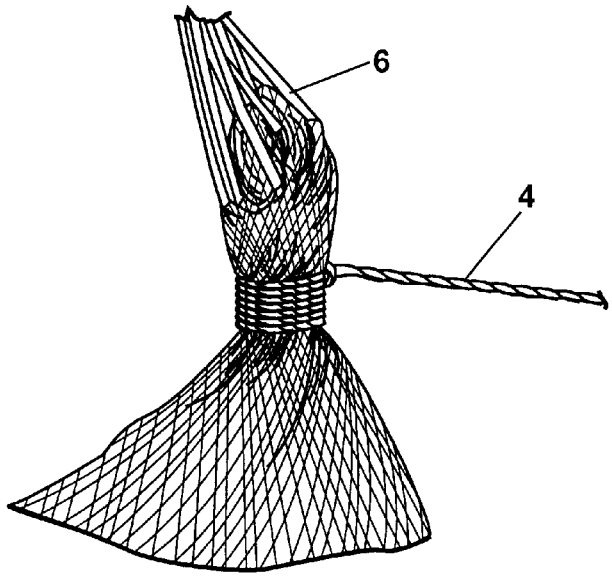
FIG. 5 is a schematic view showing the opening portion of the bag body that is temporarily suspended, which opening portion is being tied up and closed by a top closing rope.

FIG. 5 shows the opening portion of the bag body when it is closed. When the suspension loop 6 is temporarily suspended by the suspension tool, the opening portion of the bag body is gathered and temporarily closed. In this state, the top closing rope is wound around the opening portion and tied up, whereby the opening can be simply and preferably closed. In the scour prevention material of the present invention that is charged with heavy solid masses, the opening may be opened at the time of installation of the material unless the opening is firmly closed. It is thus preferable to insert the top closing rope through the mesh located below the mesh through which the suspension rope is inserted, as shown in FIG. 5.

Figure 6:
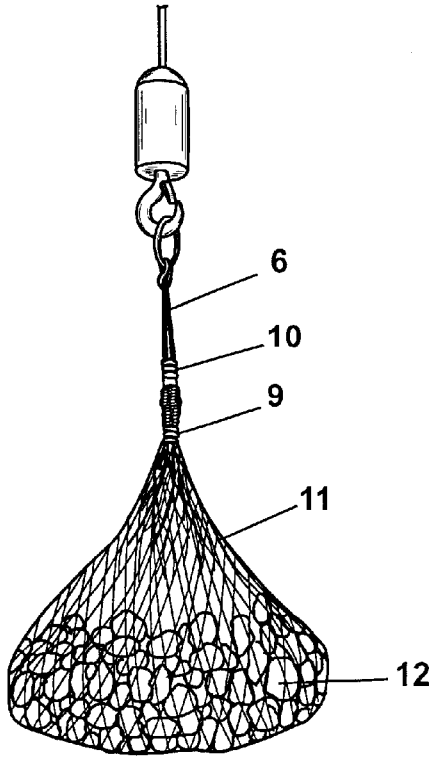
FIG. 6 is a schematic view showing the scour prevention material of the present invention when it is hung up.
Figure 7:
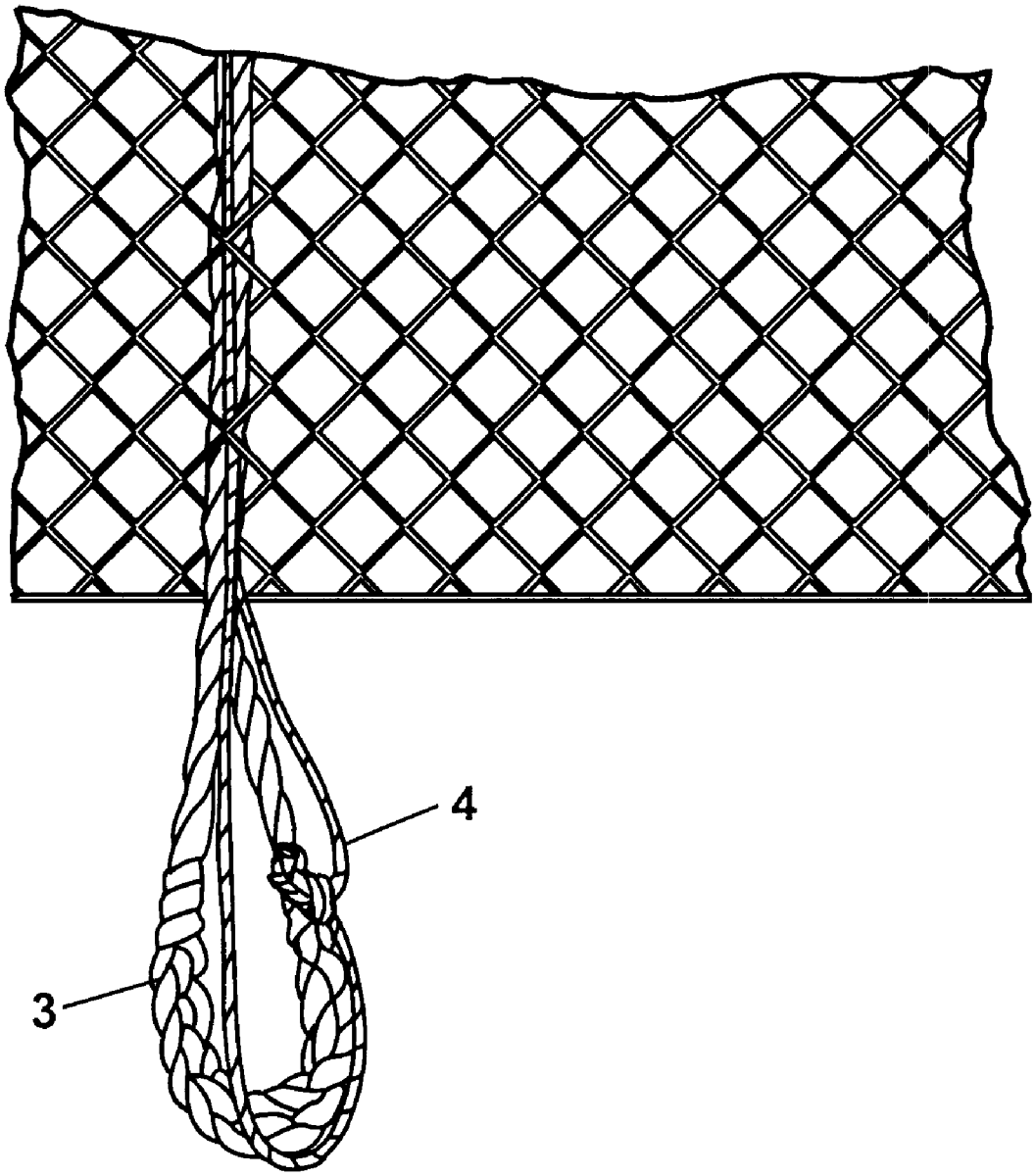
FIG. 7 is a schematic view of an alternative arrangement of a suspension rope and a top closing rope according to the present invention.

FIG. 6 shows the scour prevention material of the present invention when it is hung up, wherein a closed portion 9 obtained by closing the opening portion of the bag body, and a tied-up portion 10 of the suspension rope located above the closed portion 9 are illustrated. The suspension loops located above the closed portion 10 are preferably gathered or tied up so as not to interfere with others during installation of the scour prevention material. To this end, the suspension loops may be tied up by the remaining portion of the top closing rope.

In the scour prevention material of the present invention, a space 11 needs to be formed in the upper portion thereof when it is hung up. In the presence of the space, the shape of the scour prevention material can be changed when it is placed in position, thus assuring high adaptability to the installation position, and allowing the prevention material to be closely located in a portion that is subjected to scour of the underwater structure. In this embodiment, the space is about half of the height of the scour prevention material.

If the solid masses 12 put into the bag body reach its opening portion, the adaptability to the installation position is reduced, and it becomes difficult to place the scour prevention material closely to the desired position, with a result of a reduced scour preventing effect, even if the structure and yarn of the net are selected so as to increase the ductility. Further, it becomes difficult to firmly close the opening portion.

If the scour prevention material of the present invention is hung up by a crane, or the like, and placed in the desired installation position, the solid masses held in the bag body are not carried away by water, and thus prevented from flowing out of the bag. Since the water flows through the mesh and clearances between the solid masses, the resistance to the water stream received by the scour prevention material is small.

EXAMPLE

Eight yarns of black dope dyed nylon 1, 430 denier as a fiber material are combined, and a raschel net having a diamond mesh of 25 mm on one side and a net yarn diameter of 2 mm is knitted by a raschel knitting machine, using a multifilament of a total denier of 11,440. The raschel net is cut into the size of 8.0 mm in length and 3.0 mm in width, and folded in four in the direction of the length of 8.0 m for superposition, and the folded parts are superposed on each other and sewed together while leaving the upper side, so as to provide an envelope-like bag body having a height of 2 m and a width of 3 m.

The bag body has a porosity of 83% and a ductility of 45%. The ratio N/M of the long side (N) of the mesh to the net yarn diameter (M) is 12. 5.

A suspension rope made of nylon and having a diameter of 9 mm is inserted through the third row of the mesh as counted downward from the opening portion of the bag body. Then, a rope made of nylon and having a diameter of 6 mm is inserted through the sixth row of the mesh as counted down from the opening portion of the bag body, to thus provide a top closing rope whose opening can be closed in the manner as in the case of a purse or money pouch.

To charge the above-described bag body with solid masses, the bag body is set on an iron frame body as shown in FIG. 3, and charged with crushed stones each having a diameter of 50 mm to 200 mm and a specific gravity of 2.65, using a back hoe. The charging amounts is 1.24 $m^3$ per one bag body.

Next, the suspension rope made of nylon with a diameter of 9 mm and passing through the third row of the mesh below the opening portion of the bag body is pulled out from equally spaced, six positions of the mesh that have been marked in advance, thereby to form suspension loops suspended at six points. Further, an iron suspension tool is connected to the loops, so that the bag body is temporarily suspended by a crane. Then, the temporarily suspended bag body is placed on the ground, the suspension is loosened, and the opening position is closed by tightly winding around the top opening rope that is inserted through the sixth row as counted from the opening portion that is being closed. In this manner, the sour prevention material for the underwater structure is obtained.

The scour prevention material is moved by the truck crane, to be successively arranged and temporarily placed, and then thrown into and placed on the short protection wall of the river by using the truck crane.

The bottom of the river was hardly scoured in the vicinity of a short protection wall constructed using the scour prevention material as described above.

The present invention yields excellent effects that the resistance to the water stream is small, the shape adaptability to the installation position is excellent, and the bag is not opened during works.

The contents of Japanese patent application No. 9-336254 filed Oct. 31, 1997 including claims, specification and drawings are incorporated herein by reference.

What is claimed is:

1. A scour prevention material comprising:

a bag body for containing solid mass and preventing scour of an underwater structure, said bag body being formed into a mesh by a knitted fabric;

a suspension rope having opposite ends being inserted through the mesh and connected to each other forming a loop adjacent to an opening portion of said bag body; and a top closing rope for closing the opening of the bag body, said top closing rope being inserted through a mesh adjacent to the mesh through which the suspension rope is inserted, said suspension rope having a larger diameter than the closing rope.

2. A scour prevention material as defined in claim 1, wherein the bag body is selected from the group consisting of a knitted fabric formed as a raschel net, and a knotless net.

3. A scour prevention material as defined in claim 1, wherein the bag body is formed by a knitted fabric that has a porosity of 45% to 90% and a ductility of 30% to 80%, and satisfies a relationship as represented by $L \leqq \pi/(4\times1.9)\cdot D$ where L is a length of one side, and D is a long diameter of the solid mass.

4. A scour prevention material as defined in claim 1, wherein the suspension rope is inserted through a mesh of the opening portion.

5. A scour prevention material as defined in claim 1, wherein the suspension rope is inserted through a mesh located below the mesh of the opening portion.

6. A scour prevention material as defined in claim 1, wherein the top closing rope is inserted through a mesh located below the mesh through which the suspension rope is inserted.

7. A scour prevention material as defined in claim 1, wherein the top closing rope is inserted through the mesh through which the suspension rope is inserted.

8. A scour prevention material as defined in claim 1, wherein said body bag satisfies a relationship represented by an equation:

$$3 \leqq N/M \leqq 20$$

where M is a diameter of a net yarn, and N is a long side of the mesh.

9. The scour prevention material as defined in claim 1, wherein the suspension rope is made into the loop by tying the opposite ends of the suspension rope.

10. A fabric structure comprising:

bag means for (1) containing solid mass therein and (2) preventing scour of an underwater structure;

suspension means for allowing suspension of said bag means, said suspension means having opposite ends inserted through the bag means and connected to form a loop portion; and closing means having a smaller diameter than the suspension means for allowing closing of an open portion of said bag means.

11. A fabric structure according to claim 10, wherein said bag means is a mesh selected from the group consisting of a knitted fabric formed as a raschel net, and a knotless net.

12. A fabric structure according to claim 10, wherein said bag means is formed by a knitted fabric that has a porosity of 45% to 90% and a ductility of 30% to 80%, and satisfies a relationship as represented by $L \leqq \pi/(4 \times 1.8) \cdot D$ where L is a length of one side, and D is a long diameter of the solid mass.

13. A fabric structure according to claim 10, wherein said bag means is a mesh, and said suspension means is a suspension rope inserted through a mesh of an opening portion and said bag.

14. A fabric structure according to claim 13, wherein said top closing means is a rope inserted through a mesh located below the mesh through which said suspension rope is inserted.

15. A fabric structure according to claim 13, wherein said top closing means is a rope inserted through the mesh through which said suspension rope is inserted.

16. A fabric structure according to claim 10, wherein said bag means is a mesh and said suspension means is a suspension rope inserted through a mesh located below the mesh of an opening portion of said bag means.

17. A fabric structure according to claim 16, wherein said top closing means is a rope inserted through a mesh located below the mesh through which said suspension rope is inserted.

18. A fabric structure according to claim 16, wherein said top closing means is a rope inserted through the mesh through which said suspension rope is inserted.

19. A fabric structure according to claim 10, wherein said bag means is a mesh satisfying a relationship represented by an equation:

$$3 \leqq N/M \leqq 20$$

where M is a diameter of a net yarn, and N is a long side of the mesh.

* * * * *